United States Patent [19]

Kjeldstad

[11] Patent Number: 4,669,792

[45] Date of Patent: Jun. 2, 1987

[54] DEVICE FOR PROTECTION OF ELECTRICAL SUBSEA CONNECTORS AGAINST PENETRATION OF SEAWATER

[76] Inventor: Jan Kjeldstad, Nardoveien 4B, 7000 Trondheim, Norway

[21] Appl. No.: 801,757

[22] Filed: Nov. 26, 1985

[30] Foreign Application Priority Data

Nov. 26, 1984 [NO] Norway ..... 844685

[51] Int. Cl.[4] ..... H01R 13/523

[52] U.S. Cl. ..... 439/38; 439/199; 439/190

[58] Field of Search ..... 339/12 R, 12 G, 115 R, 339/115 C, 117 R, 118 R

[56] References Cited

U.S. PATENT DOCUMENTS 4,373,767 2/1983 Cairns ..... 339/117 R 4,390,229 6/1983 Chevalier ..... 339/117 R 4,500,155 2/1985 Chevalier ..... 339/117 R

FOREIGN PATENT DOCUMENTS 1030896 7/1983 U.S.S.R. ..... 339/12 R

*Primary Examiner*—John McQuade

[57] ABSTRACT

A device for protecting an electrical subsea connector from seawater and increasing the magnetic conductivity in an inductive type electrical subsea connector is disclosed. The device is made up of a reservoir containing an oil-based ferromagnetic fluid under pressure. The reservoir is in communication with the female cavity of the connector and the female cavity is equipped with permanent magnets to prevent the magnetic fluid from leaking out. The ferromagnetic fluid is at a pressure exceeding the pressure of the surrounding seawater.

12 Claims, 5 Drawing Figures

DEVICE FOR PROTECTION OF ELECTRICAL SUBSEA CONNECTORS AGAINST PENETRATION OF SEAWATER

This invention relates to a device for the protection of electrical subsea connectors against the penetration of seawater. More particularly, it relates to galvanic subsea connectors and inductive subsea connectors that are arranged for mating and unmating under water. Other aspects of the device according to the invention are that these connectors are of the kind that comprise a more or less plug-shaped member or male part and a more or less sleeve-formed member or female part wherein the female part is designed with a cavity for reception of the insertion member of the corresponding male part during mating. The cavity containing or can be filled with a substance that prevents penetration of seawater.

The fundamental construction and function of such subsea connectors are well known and are not the object of the present invention.

Conventional galvanic subsea connectors generally comprise a sleeve-formed part or female part with a cavity shaped to receive the corresponding insertion member which is a plug-shaped member or male part. Gaps into which seawater may penetrate form between female and male parts after mating.

In inductive connectors the two mentioned parts are by and large identical and each comprises a core of ferrite with winding. Also in such connectors, gaps are formed between the parts when mated. This may take place by particles settling between the contact surfaces.

One problem concerning galvanic connectors for connection and disconnection under water is the penetration of seawater and contaminants into the female part during the mating operations. Another problem is associated with the micro-migration of seawater through non-metallic packings.

Inductive contacts for disconnection and connection under water are sensitive to very small gaps between the contact surfaces. A gap of 0.4 mm will reduce the effective transmission capacity of a cable down to only 5% of that which would have been possible without any gaps. This applies to two connectors, one in each end of the cable, and with equally large gaps.

To protect electrical subsea connectors against penetration of seawater, O-ring seals made of inorganic material have been used. The barrier between seawater and the contact is consequently an O-ring.

Applying to the female part, a water-repellent gel kept in place by a membrane made with accurately dimensioned and situated lead-through openings for the admission of plug pins and for the extraction of same has also been practiced. Thus, in a connected state, the contact site is then surrounded by isolating gel.

Destruction of or damage to the O-ring packing which often occurs during mating and unmating operations will entail penetration of seawater and permanent short-circuiting to earth and corrosion of the contacts. Another shortcoming when using an O-ring as a barrier between seawater and contact site is that over a longer period of time a micro-migration of water will take place. Consequently, the the O-ring design does not form a pressure barrier to the micro-migration of water.

The isolating gel with the same pressure as the surrounding seawater does not form a pressure barrier to counteract micro-migration of water. If the gel is damaged or removed, water will flow into the contact site.

Mating and unmating can only be carried out a very limited number of times because during every mating operation a little gel will be lost and there is no possibility of refilling in the subsea position.

This invention remedies the drawbacks and shortcomings of the prior art devices and discloses a device which will effectively prevent the penetration and micro-migration of seawater into the subsea connectors and make inductive connectors far less sensitive to gaps between the contact surfaces. Furthermore, it is another object of the present invention to increase the magnetic conductivity in said gaps in inductive subsea connectors.

According to the present invention, this is obtained by designing a device for the protection of electrical subsea connectors against the penetration of seawater in particular galvanic connectors and inductive connectors which are arranged for subsea mating and unmating, which connectors are of the kind that comprise a more or less plug-shaped member or male part and a more or less sleeve-formed member or female part, wherein the female part is designed with a cavity for reception of the insertion member of the corresponding male part during mating. The cavity containing or can be filled with a substance that prevents penetration of water. The device is characterized by the female part being connected to a reservoir with ferromagnetic fluid under pressure. The reservoir is in communication with the cavity of the female part for filling and refilling of the cavity and the gap between the insertion member and the cavity wall(s) after mating, respectively. The pressure of said ferromagnetic fluid exceeding that of the surrounding seawater, the purpose of which is to prevent penetration into the cavity of the female part when mated or unmated. A permanent magnet assembly surrounding the cavity of the female part prevents the ferromagnetic fluid from leaking out into the surrounding seawater.

Preferred embodiments of the device according to the invention are further defined where the subsea connector is a galvanic connector, in which case the cavity of the female part comprises an axial, extended, cylinder-shaped bore for reception of the corresponding plug-shaped insertion member of the male part. A narrow gap, of up to 5 mm by example, can be formed between the cavity wall and the insertion member. Here the invention is characterized by comprising a plurality of, for example 5–6, permanent magnets arranged coaxially one after the other with mutual spaces in between themselves in the axial direction of the female part. The magnetic fields from each of the permanent magnet, which together in the shape of a ring enclose the cavity of the female part, establish an increase in the hydrostatic pressure of the ferromagnetic fluid thereby preventing said fluid from leaking out into the surrounding seawater.

Another preferred embodiment of this invention for an inductive connector is where the female part has two concentric, ring-shaped cavities for filling with ferromagnetic fluid under pressure and for reception of the corresponding insertion member of magnetically conductive material (ferrite) of the male part. In the vicinity of the terminal end of said part facing the male part, concentric permanent magnetic rings are built into the female part and in the case of two concentric ring-shaped cavities, three permanent magnetic rings are employed, each with two pole-shoe rings, whereby the permanent magnets, besides preventing the leakage of ferromagnetic fluid into the seawater, also facilitiate the magnetic conductivity in the gap between the male and the female parts.

Still another preferred embodiment of this invention is characterized by having a non-return valve in the conduit between the reservoir and the cavity of the female part. The non-return valve permits the ferromagnetic fluid by pressure to flow toward the cavity of the female part, but prevents the flow of fluid in the opposite direction.

Yet another preferred embodiment of this invention is characterized by having the reservoir which by way of example can be in the shape of a cylindrical container and mounted on the female part, is equipped with a built-in, transversial memberane, which if necessary is acted upon by a spring through the coupling to a pressure-plate. The reservoir above the membrane is equipped with a hollow, flexible, compressable member which is able to elastic deformation and which contains a fluid, preferably ferromagnetic fluid on oil-basis. When said hollow member is being compressed by the action of the pressure of the seawater, the ferromagnetic fluid is forced into the reservoir above the membrane and thereby acts through pressure on this.

According to the invention, oil-based ferromagnetic fluid is forced into the area around the contact site from a reservoir having a higher pressure than the surrounding seawater. The pressurized ferromagnetic fluid is prevented from leaking into the seawater with the aid of permanent magnets enveloping the cavity of the female part. Gaps between male and female parts should not be wider than 5 mm in order to achieve a powerful magnetic field at reasonable dimensions on the permanent magnets. For inductive connectors the device according to the invention has an important additional function: A possible gap between the male and female parts is filled with magnetic fluid that will increase the magnetic conductivity of the gap.

The magnetic field from each permanent magnet ring establishes an increase in the hydrostatic pressure of the ferromagnetic fluid equal to:

$$P=\tfrac{1}{2}M\,B$$

where M is the fluid's magnetization in A/m and B is the value of the magnetic field in the gap measured in Weber/m$^2$. Obtainable values are:

$B=0.8$ Weber/m$^2$ $M=50{,}000$ A/M $p=\frac{1}{2}\cdot(5\cdot10^4\cdot0.8)=2\cdot10^4 N/M^2=0.2$ bar This means that the fields from each of the permanent magnet rings can take up a pressure difference of around 0.2 bar.

Five magnet rings placed at suitable intervals in the gap's axial direction will then be capable of balancing the 1 bar's overpressure in the ferromagnetic fluid so that it does not leak into the seawater. At 1 bar overpressure there should, however, be used six permanent rings in order to have a safety margin against leakage.

Each of the embodiments may be designed in such a way that on mating under water the hollow space in the void becomes smaller and oil-based ferromagnetic fluid is pressed out, preventing the seawater from penetrating during the mating operation.

According to the invention the barrier between the contact site and seawater will then consist of ferromagnetic fluid with overpressure. Possible water penetration will then have to overcome a pressure potential of around 1 bar.

Destruction of the isolating magnetic fluid will occur when seawater infects the magnetic fluid. Seawater-infected magnetic fluid will lose its magnetic qualities and no longer be kept in place by the magnetic fields from the permanent magnetic rings. When the seawater infects the magnetic fluid and causes it to lose its magnetic properties, it will be squeezed out into the seawater and be replaced by new fluid from the overpressure reservoir. The oil-based ferromagnetic fluid will thus act as a self-repairing isolator against seawater. On mating the male part will expel ferromagnetic fluid from the female parts' cavity.

As the ferromagnetic fluid is under overpressure, it represents a far more effective barrier to micro-migration than does gel with the same pressure as the seawater.

Known ferromagnetic fluid are two phase compositions comprising finely distributed particles of ferromagnetic material, typically magnetite ($Fe_3O_4$), in a liquid carrier. The particles have to be small enough to be kept in suspension. Typical particle dimensions are 100–150 A. The magnetic properties of the fluids are due to these particles. The fluid's electrical properties depend on the liquid phase. According to the present invention, it is preferred to utilize an electrically non-conductive liquid which is non-dissolvable in water, for instance a liquid hydrocarbon, as the carrier phase. Mineral oil-based ferromagnetic fluids having magnetic saturation values up to 50,000 A/m are commercially available and may for instance be obtained from Ferrox of Oxford, U.K.

As mentioned before, conventional inductive connectors for mating and unmating under water are sensitive to very small gaps between the contact surfaces. If on the other hand, the gap between the contact surfaces is filled with ferromagnetic fluid according to the invention, a gap of up to five times as large as is tolerable with conventional inductive connectors can be tolerated. The relative magnetic susceptibility for ferromagnetic fluid may be up to 5. On mating the displaced ferromagnetic fluid will flow out into the seawater and prevent particles from settling between the contact surfaces.

The invention is explained in the following in connection with a couple of embodiments shown in the drawings, where FIGS. 1–4 represent a first embodiment, here in connection with an galvanic connector for mating and unmating under water. Equal or functionally equally good parts are described with corresponding reference numbers, and in addition there is a prime for the embodiment according to FIG. 5. The individual figures show:

Figure 1:
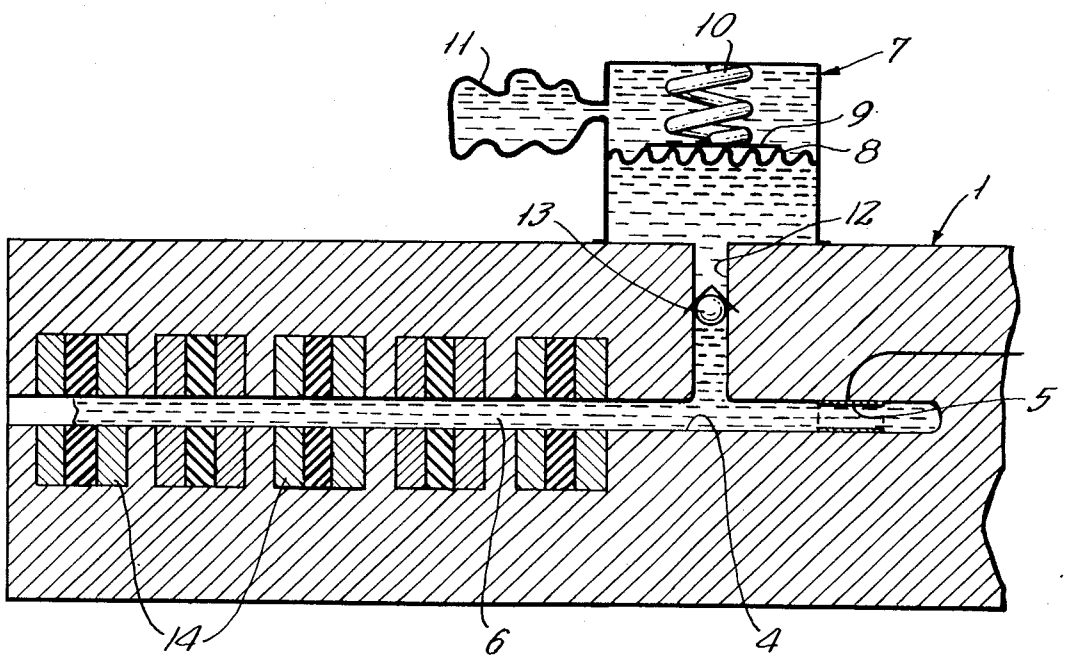
FIG. 1 is an axial cross section through a female part for the galvanic contact mentioned, with a mounted reservoir for ferromagnetic fluid.

The female part is for both the connector embodiments planned to be an integrated part of a subsea installation.

In the embodiment according to FIGS. 1–4 the female part 1 has a long, axial, cylinder-shaped cavity 4 with a copper contact ring 5 near the cavity's inner end. The cavity's middle and outer part is surrounded by five permanent magnetic rings 14, mutually spaced along the axis of the cavity. The cavity 4 is via a conduit 12 with a check valve 13 connected to a reservoir 7 with oil-based ferromagnetic fluid 6 which is kept at a pressure at the connection site. The permanent magnets at the cavity's outer part maintain the magnetic fields inside the cavity 4, so that the ferromagnetic fluid is stopped by the fields even if it has some overpressure.

The magnetic fields act on the ferromagnetic fluid 6 by forming a number of series-connected pressure-reducing "valves" each of which can withstand a certain differential pressure. In the following, these fields will be called "ferromagnetic valves". Because of the overpressure, the ferromagnetic fluid 6 will flow out into the cavity and fill this, but is halted by the fields at the cavity's outer part, as the check valve 13 in the conduit 12 prevents a flow back to the reservoir 7, yet permits fluid flow in the opposite direction.

Figure 2:
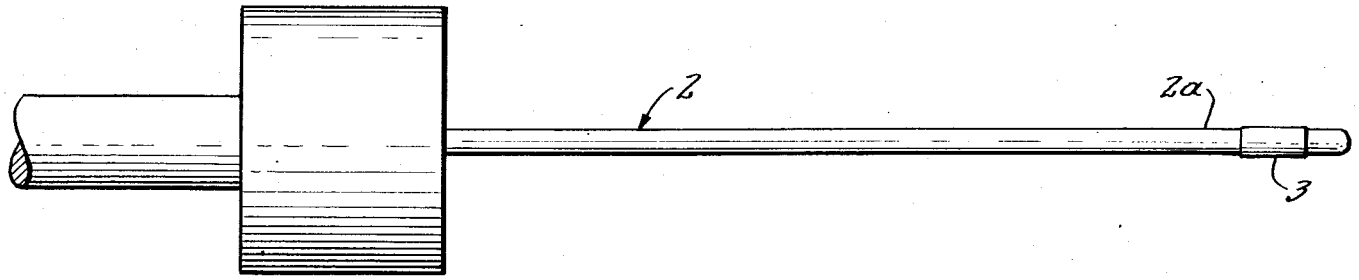
FIG. 2 shows an outline of a male part entering into the same contact.
Figure 3:
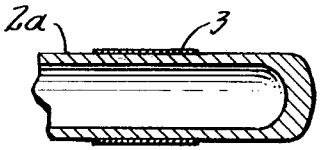
FIG. 3 is the free end piece of the male part in FIG. 2, shown in cross-section and in a larger scale.
Figure 4:
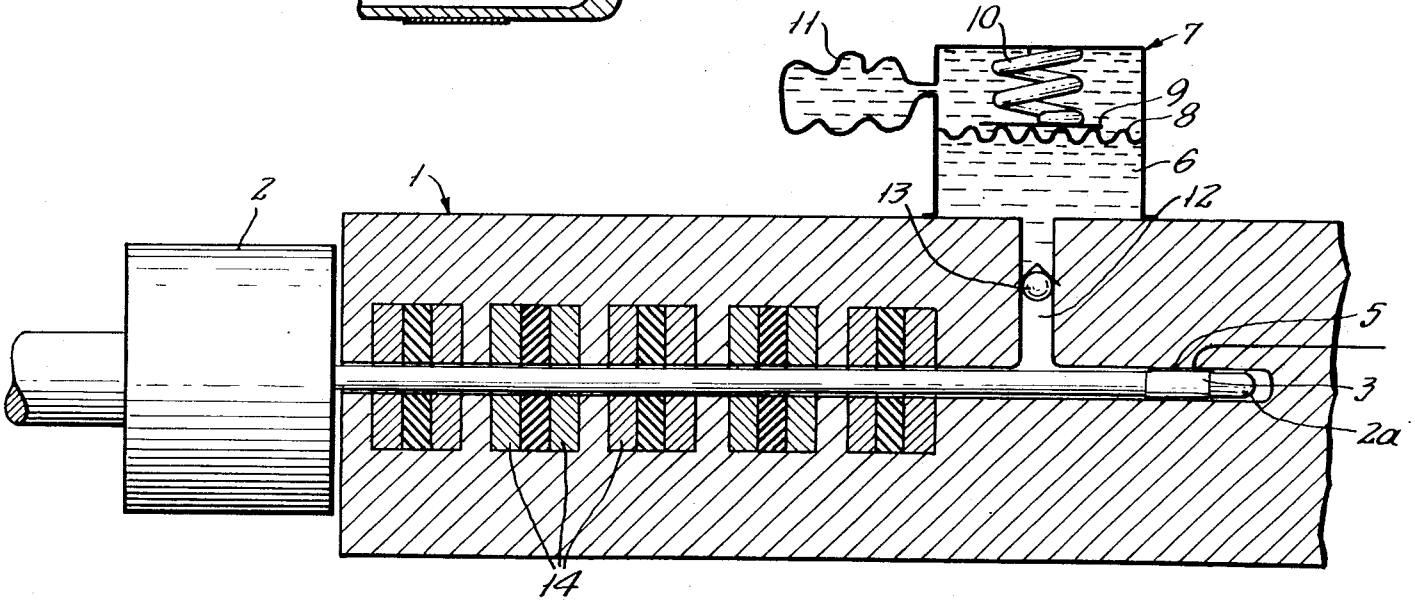
FIG. 4 is the male and female parts according to FIGS. 2 and 1 respectively, in mated position.

The male part in FIGS. 2 and 3 has the shape of a closed hollow cylinder whose free exterior end 2*a* carries a contact ring 3 made of copper which is designed to cooperate with the copper ring 5 innermost in the female part's cavity. The live wire does not extend in the cavity 4; the cylinder walls consist of a material having good magnetic conductivity.

Mating under water takes place by pushing the male part 2 through the mentioned ferromagnetic "valves", the magnetic fields, into the female part. Ferromagnetic fluid is thereby pressed out along the gap between the cylinder-shaped male part 2 and the walls of the cavity 4. This prevents water and contaminants from penetrating the cavity during the mating operation. The gap between the cavity's walls and the male part ensures that expelled fluid can freely flow out.

When mated, the ferromagnetic fluid at the fields in the gap between the male parts's outer cylinder wall and the female part's cavity wall acts as multi-stage ferromagnetic "O-rings". These "O-rings" prevent the ferromagnetic fluid with overpressure from leaking out and is an extra barrier against micro-penetration of water. If these "O-rings" should be damaged, they will be replaced by new ferromagnetic fluid being pressed into the fields and being kept in place there.

When unmating, the cylinder-shaped male part 2 is pulled out of the cavity 4, and the ferromagnetic fluid fills up the volume which is thereby released, but is stopped from leaking out by the magnetic field in the outer part of the cavity.

Figure 5:
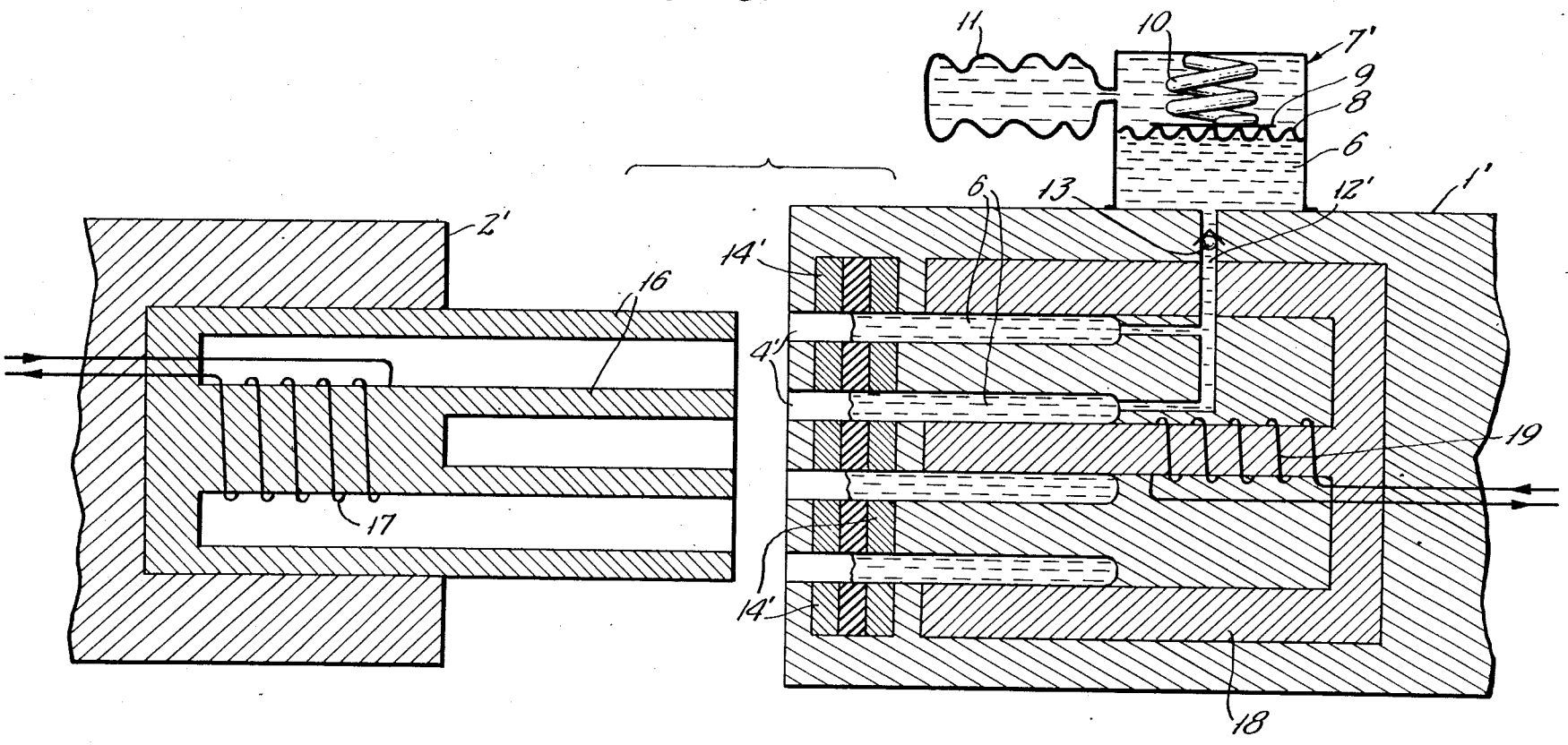
FIG. 5 is a cross-section through the male and female parts of an inductive connector, right before mating or right after unmating.

In the electrical inductive connection or contact according to FIG. 5, the oil-based ferromagnetic fluid also serves in the capacity of increasing the magnetic conductivity in possible gaps between male and female parts, 2′ and 1′ respectively. The principle of overpressure reservoir 7′ and the forcing of ferromagnetic fluid into the female part's 1′ cavity 4′ is the same as in the embodiments according to FIGS. 1–4. The ferromagnetic fluid will give protection to the female part also in the case where the connector is in a disconnected state.

This connector is designed so that possible gaps between the ferrite cores, 16 and 18 respectively, in male part 2′ and female part 1′, after mating are filled with ferromagnetic fluid 6 with high magnetic susceptibility. The fluid's relative susceptibility will be around 5. The two ferrite cores' 16 and 18 windings are called 17 and 19 respectively.

A relative susceptibility of 5 means that with the same requirements for curbing, a five times larger gap can be tolerated when using ferromagnetic fluid filling.

When unmated, the female part 1′ is filled with ferromagnetic fluid which is kept in place with permanent magnets 14′. This prevents penetration of contaminants which again could have led to gaps on connection.

This connector is designed in such a way that the two contact surfaces between male and female parts are as large as possible. The magnetic resistance in a gap is in reverse ratio to the contact area. For this purpose, the male part's 2′ insertion organ, the ferrite core 16, is shaped like two concentric cylinder walls, while the female part's 1′ cavity is correspondingly shaped, i.e. as two concentric hollow cylinders 4′, deep circular grooves. The magnetic flux must pass through two coupling surfaces, so that the course of the flux must pass through the windings from one coupling surface to the next. For the male part 2′ the outer side of the external and the inner side of the internal cylinder wall 16 represent the contact surfaces.

The two milled circular grooves 4′, comprising the female part's cavity, are connected to a reservoir 7′ of ferromagnetic fluid 6 with a certain overpressure. The fluid 6 is pressed out into the two circular groove cavities 4′, but is stopped by the fields from the permanent magnets 14′ which are in the shape of rings and are situated on both sides of the cavities. There are a total of three permanent magnet rings, each with two pole-shoe rings.

The reservoir 7; 7′ is mounted on the female part 1; 1′ in the shape of a container, for instance cylindrical shape, and has in the illustrated embodiments a built-in, transversal membrane 8, that through a possible intercoupling to a pressure plate 9 is influence by a pressure screw spring 10 in the direction of the female part. Above the membrane 8 the reservoir is equipped with a hollow, flexible, compressible, elastically deformable body 11, containing a fluid, preferably oil-based ferromagnetic fluid. When this hollow body 11 is compressed by the hydrostatic pressure at a certain depth of water, a smaller or larger part of the fluid originally contained therein will be pressed into the chamber of the reservoir 7 which is situated over the membrane 8, where it together with the similar action of spring number 10 will exercise a pressure on membrane 8 and on the underlying ferromagnetic fluid 6 in the direction of the female part's cavity. The pressure screw spring 10 is not dependent on the pressure in the surrounding seawater and therefore will also exercise its function in the same manner on shallower water.

It is to be understood that the connector according to the invention has to be constructed in a manner to avoid electrical contact between conductors, contact surfaces 3, 5 and leads and the rest of the connector. For this purpose electrically non-conductive materials have to be utilized in construction of certain parts of the connector, either as coating or as hole parts.

Preferably each of the magnet units 14 comprises a permanent magnet shaped as a disc with a concentric hole, indicated as heavily hatched areas in the drawings of the magnetic units 14, the polarization of the magnet being such that each side of the disc carries opposite magnetic poles, and similar shaped pole-shoes, indicated as less heavily hatched areas in said drawings, placed on each side of the magnetic disc. The purpose of the pole-shoes is to concentrate the magnetic field in the cavity 6 of the female part 1, 1' and consequently they are made of a material of high magnetic permeability such as soft iron.

It will be understood that the claims are intended to cover all changes and modifications of the preferred embodiment of the present invention herein chosen for the purpose of illustration which do not constitute a departure from the spirit and scope of the invention.

What is claimed is:

1. In a subsea electrical connector having a male member, said male member having an insertion member, and a female member, said female member having a cavity for receiving said male insertion member, the improvement comprising: a reservoir containing a pressurized ferromagnetic fluid, said reservoir being in communication with said female cavity thereby allowing said ferromagnetic fluid to communicate with said female cavity, said ferromagnetic fluid being maintained at a pressure greater than that of the surrounding seawater; and a permanent magnet assembly surrounding said female cavity and being capable of preventing said ferromagnetic fluid from leaking out of said female cavity.

2. The subsea electrical connector of claim 1 wherein said permanent magnet assembly comprises a plurality of permanent magnets.

3. The subsea electrical connector of claim 1 wherein said connector is an inductive-type connector, said male insertion member comprises two concentric ring-shaped male insertion members and said female cavity comprises two concentric ring-shaped female cavities for receiving said male insertion members, said permanent magnet assembly comprising three concentric permanent magnetic rings positioned at the open end of said ring-shaped female cavities, each permanent magnetic ring having two pole-shoe rings.

4. The subsea electrical connector of claim 1 further comprising a one-way valve that permits said ferromagnetic fluid to flow from said reservoir to said cavity but prevents flow in the opposite direction.

5. The subsea electrical connector of claim 1 further comprising a bladder in communication with said reservoir, said bladder being compressed by the pressure of surrounding seawater; and a pressure means which provides pressure to said ferromagnetic fluid such that the combined pressure of said bladder and said pressure means is greater than that of the surrounding seawater.

6. The subsea electrical connector of claim 5 wherein said pressure means is a transversal membrane situated in said reservoir and a spring coupled with a pressure plate which rests upon said transversal membrane.

7. The subsea electrical connector of claim 1 wherein said ferromagnetic fluid is maintained at an over-pressure of about 1 bar.

8. The subsea electrical connector of claim 2 wherein said permanent magnets are arranged one after the other in an axial direction along said cavity.

9. A subsea electrical connector comprising:

(a) a male member having an insertion member;

(b) a female member having a cavity for receiving said male insertion member;

(c) a reservoir containing a ferromagnetic fluid in communication with said female cavity;

(d) means for pressurizing said ferromagnetic fluid to a pressure greater than that of the surrounding seawater; and (e) a magnet assembly surrounding said female cavity and preventing said ferromagnetic fluid from leaking out of said female cavity.

10. The subsea connector of claim 9 wherein said magnet assembly comprises at least one permanent magnet.

11. The subsea connector of claim 10 wherein said permanent magnet assembly is a plurality of permanent magnets.

12. The subsea connector of claim 1 wherein said means for pressurizing said ferromagnetic fluid is a hollow, flexible, compressible bladder which is in fluid communication with said reservoir and which contains additional ferromagnetic fluid, said bladder being compressed by the pressure of surrounding seawater; and a transversal membrane which is situated in said reservoir upon which a spring exerts pressure down onto said transverse member.

* * * * *

UNITED STATES PATENT AND TRADEMARK OFFICE

CERTIFICATE OF CORRECTION

PATENT NO. : 4,669,792

DATED : June 2, 1987

INVENTOR(S) : Jan Kjeldstad

It is certified that error appears in the above-identified patent and that said Letters Patent is hereby corrected as shown below:

Claim 12, line 1, change the dependency from "claim 1" to --claim 11--.

Signed and Sealed this

Tenth Day of November, 1987

*Attest:*

DONALD J. QUIGG

*Attesting Officer*

*Commissioner of Patents and Trademarks*